US011485150B2

(12) United States Patent
Nakano

(10) Patent No.: US 11,485,150 B2
(45) Date of Patent: Nov. 1, 2022

(54) PRINTING APPARATUS

(71) Applicant: SEIKO EPSON CORPORATION, Tokyo (JP)

(72) Inventor: Shuichiro Nakano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/208,429

(22) Filed: Mar. 22, 2021

(65) Prior Publication Data

US 2021/0300070 A1 Sep. 30, 2021

(30) Foreign Application Priority Data

Mar. 24, 2020 (JP) ..... JP2020-052853

(51) Int. Cl.
*B41J 11/00* (2006.01)

(52) U.S. Cl.
CPC ..... *B41J 11/00222* (2021.01); *B41J 11/003* (2013.01); *B41J 11/00224* (2021.01)

(58) Field of Classification Search
CPC ..... B41J 11/00222; B41J 11/00224
See application file for complete search history.

(56) References Cited

U.S. PATENT DOCUMENTS

2009/0002412 A1* 1/2009 Kawakami ..... B41J 2/16585 347/8
2012/0062638 A1* 3/2012 Toya ..... B41J 11/0085 347/16
2018/0037022 A1 2/2018 Sasaki et al.
2018/0229512 A1* 8/2018 Katagami ..... B41J 15/04
2018/0333971 A1 11/2018 Sasaki

FOREIGN PATENT DOCUMENTS

CN 104786673 A * 7/2015 ..... B41J 11/0095
JP 2018-020489 2/2018
JP 2018-192690 12/2018

* cited by examiner

*Primary Examiner* — Justin Seo
(74) *Attorney, Agent, or Firm* — Workman Nydegger

(57) ABSTRACT

A printing apparatus includes a liquid ejecting unit configured to eject liquid to a medium, a medium supporting unit configured to support the medium on a support face, a medium width detector configured to detect a width of the medium supported at the supporting face. Further, the printing apparatus includes a plurality of air blowing ports provided along a width direction (X-axis direction) of the medium for blowing air toward the medium supporting unit, an air blowing unit from which the air is blown, a heating unit configured to heat the medium supporting unit. Further, the printing apparatus includes a controlling unit configured to control a blowing amount from each of the plurality of air blowing ports according to the width of the medium detected by the medium width detector.

4 Claims, 4 Drawing Sheets

PRINTING APPARATUS

The present application is based on, and claims priority from JP Application Serial Number 2020-052853, filed Mar. 24, 2020, the disclosure of which is hereby incorporated by reference herein in its entirety.

BACKGROUND

1. Technical Field

The present disclosure relates to a printing apparatus such as an inkjet printer.

2. Related Art

A printing apparatus having a structure for supporting a medium on a support face of a medium supporting unit including a heating unit, for heating and performing printing on the medium, and blowing air to ink ejected onto the medium from an air blowing unit for drying the ink is known (JP-A-2018-20489).

In the medium supporting unit, when the air is blown to a region not covered with the medium, a temperature thereof becomes lower than that of a region covered with the medium. As a result, a temperature at an end portion of the medium also decreases. When the temperature at the end portion of the medium decreases, the temperature in the width direction of the medium becomes uneven, which may lead to deterioration of printing image quality.

However, JP-A-2018-20489 does not describe the problem of the temperature decrease at the end of the medium, and also there is no suggestion thereof.

SUMMARY

In order to solve the above-described issue, a printing apparatus according to the present disclosure includes a liquid ejecting unit configured to eject liquid to a medium, a medium supporting unit configured to support the medium on a support face, a medium width detector configured to detect a width of the medium supported at the supporting face, a plurality of air blowing ports provided along a width direction of the medium for blowing air toward the medium supporting unit, an air blowing unit from which the air is blown, a heating unit configured to heat the medium supporting unit, and a controlling unit configured to control a blowing amount from each of the plurality of air blowing ports according to the width of the medium detected by the medium width detector.

DESCRIPTION OF EXEMPLARY EMBODIMENTS

Figure 1:
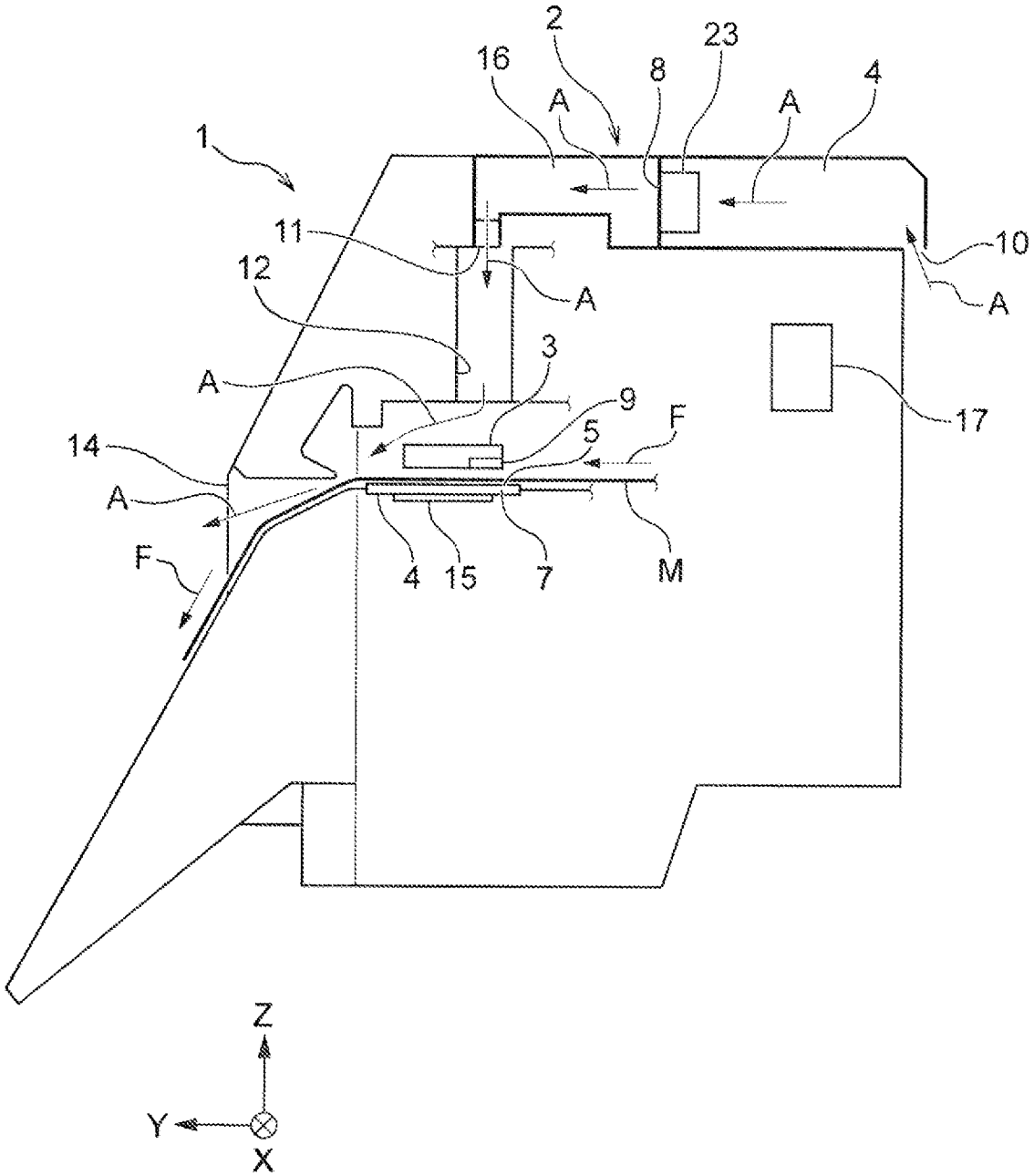
FIG. 1 is a schematic cross-sectional side view of a printing apparatus according to First Exemplary Embodiment.

The present disclosure will be schematically described below.

In order to solve the above-described issue, a first aspect of a printing apparatus according to the present disclosure includes a liquid ejecting unit configured to eject liquid to a medium, a medium supporting unit configured to support the medium on a support face, a medium width detector configured to detect a width of the medium supported at the supporting face, a plurality of air blowing ports provided along a width direction of the medium for blowing air toward the medium supporting unit, an air blowing unit from which the air is blown, a heating unit configured to heat the medium supporting unit, and a controlling unit configured to control a blowing amount from each of the plurality of air blowing ports according to the width of the medium detected by the medium width detector.

Here, "a blowing amount from each of the plurality of air blowing ports" in "to control a blowing amount from each of the plurality of air blowing ports" is also used in the meaning of controlling a blowing amount of each predetermined range in which a plurality of air blowing ports are put together, in addition to the meaning of controlling a blowing amount of each of the air blowing ports.

According to the present aspect, the controlling unit controls the blowing amount from each of the plurality of air blowing ports according to the width of the medium detected by the medium width detector. As a result, the amount of air that strikes a region not covered with the medium is reduced, and thus a temperature decrease of that portion can be suppressed. Thus, a temperature decrease at an end portion of the medium can be suppressed.

According to the printing apparatus of a second aspect of the present disclosure, the medium supporting unit includes an alignment unit configured to align a side of the medium on one end side of the medium supporting unit in the width direction, and the controlling unit adjusts the blowing amount from each of the air blowing ports located at a position corresponding to the other end side of the medium, according to the width of the medium, in the first aspect.

According to the aspect, the controlling unit adjusts, according to the width of the medium, the blowing amount from each of the air blowing ports located at a position corresponding to the other end side of the medium which is at the opposite side to the alignment unit. That is, since the blowing amount from each of the air blowing ports is adjusted on a side where there is a region not covered with the medium, the temperature decrease at the end portion of the medium is efficiently suppressed.

According to the printing apparatus of a third aspect of the present disclosure, the air blowing unit includes a plurality of fans provided along the width direction of the medium, in a region between the plurality of fans and the plurality of air blowing ports, a partition is arranged between each fan next to each other, air from each fan is blown out from an air blowing port provided in a range partitioned by the partitions, and the controlling unit controls the blowing amount from each of the air blowing ports by adjusting an output of each fan according to the width of the medium, in the first or second aspect.

According to the present aspect, the controlling unit controls the blowing amount from each of the air blowing ports by adjusting each output of the fans according to the width of the medium. That is, the blowing amount from each of the corresponding air blowing ports can be adjusted by adjusting the blowing amount from each fan. As a result, the blowing amount from each of the air blowing ports can be adjusted with a simple structure, and thus the temperature decrease at the end portion of the medium can be suppressed.

According to the printing apparatus of a fourth aspect of the present disclosure, a movable partition plate movable between the one end side and the other end side in the width direction of the medium supporting unit is arranged in a flow path between the air blowing units and the plurality of air blowing ports, and the controlling unit controls the blowing amount from each of the air blowing ports by changing a position of the movable partition plate according to the width of the medium, in the second aspect.

According to the present aspect, the controlling unit controls the blowing amount from each of the air blowing ports by changing the position of the movable partition plate according to the width of the medium. As a result, by moving the movable partition plate between regions not covered and covered with the medium, the blowing amount can be effectively reduced.

According to the printing apparatus of a fifth aspect of the present disclosure, the heating unit includes a plurality of heaters provided along the width direction of the medium, in any one of the first to fourth aspects.

According to the present aspect, since the heating unit is constituted by the plurality of heaters provided along the width direction of the medium, heating unevenness in the width direction of the medium can be reduced.

According to the printing apparatus of a sixth aspect of the present disclosure, the each of the air blowing ports has the same size, in any one of the first to fifth aspects.

According to the present aspect, since each air blowing port has the same size, it is easy to adjust the blowing amount.

First Exemplary Embodiment

The First Exemplary Embodiment of a printing apparatus according to the present disclosure will be described below in detail with reference to FIGS. 1 to 3.

In the following description, three axes orthogonal to each other are denoted as X-axis, Y-axis, and Z-axis, respectively, as illustrated in each drawing. The Z-axis direction corresponds to a vertical direction (a direction in which gravity acts). The X-axis direction and the Y-axis direction correspond to a horizontal direction. Here, the Y-axis direction corresponds to a transport direction of a medium, and the X-axis direction corresponds to a width direction of the medium which intersects the transport direction.

In these drawings, an inkjet printer is described as an example of a printing apparatus 1. The printing apparatus 1 ejects ink that is an example of liquid onto a medium M and records various information. Examples of the medium M include those made of various materials such as a paper (roll paper, cutform paper), a textile (woven fabric, cloth, and the like).

Figure 2:
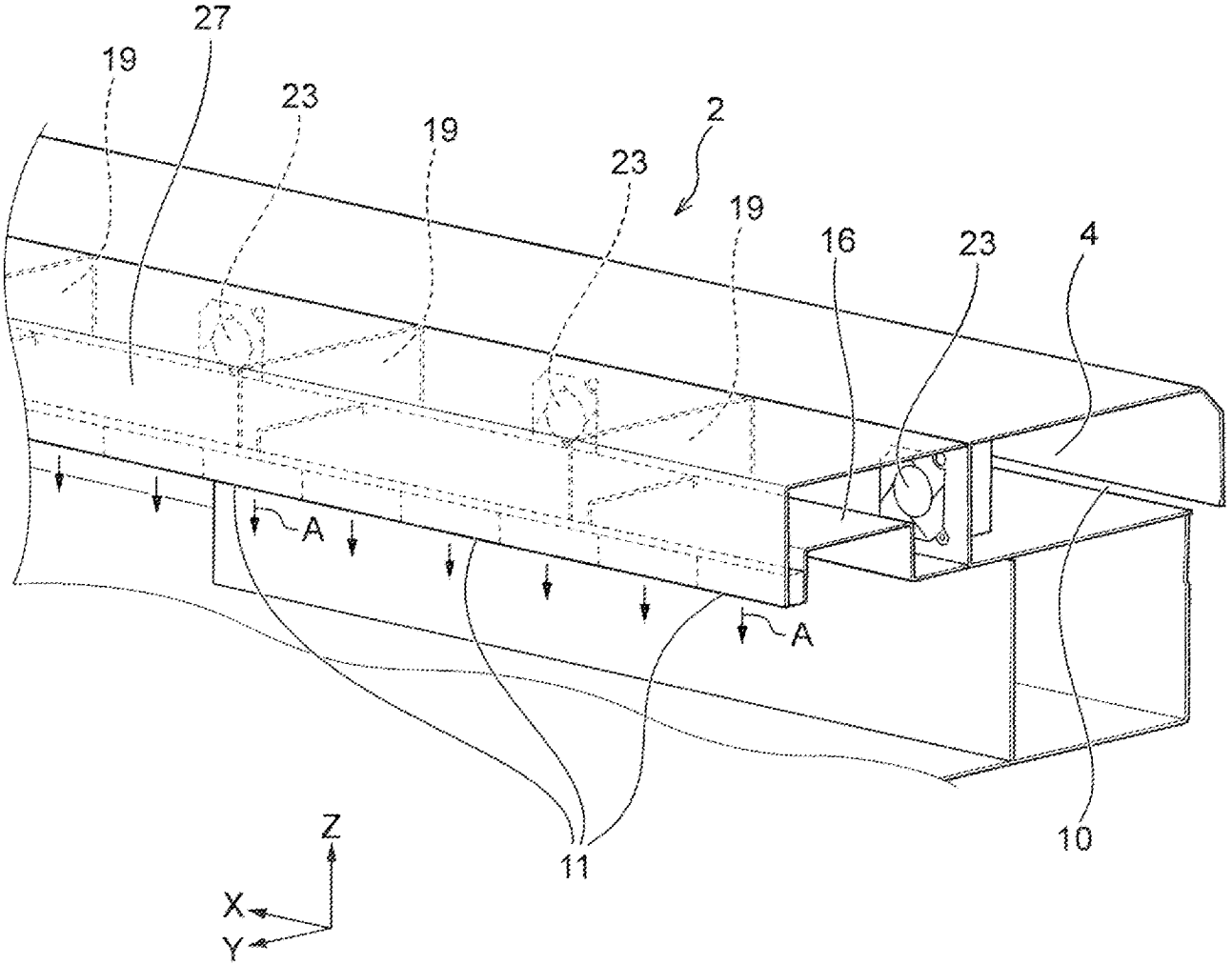
FIG. 2 is a partial cross-sectional perspective view of an air blowing unit of the printing apparatus according to the First Exemplary Embodiment.

As illustrated in FIGS. 1 and 2, according to the present embodiment, the printing apparatus 1 includes a liquid ejecting unit 3 that ejects liquid ink onto the medium M, a medium supporting unit 7 that supports the medium on a support face 5, and a medium width detector 9 that detects a width d of the medium M supported by the support face 5. Further, the printing apparatus 1 includes a plurality of air blowing ports 11, 11, . . . for blowing air toward the medium supporting unit 7 and provided along a width direction (X-axis direction) of the medium M, an air blowing unit 23 that serves as a blowing source of the blowing, and a heating unit 15 that heats the medium supporting unit 7. Further, the printing apparatus 1 includes a controlling unit 17 that controls a blowing amount from each of the plurality of air blowing ports 11, 11, . . . according to the width d of the medium M detected by the medium width detection unit 9.

Each element of the printing apparatus 1 will be described in detail below.

Liquid Ejecting Unit

The liquid ejecting unit 3 has a plurality of nozzle rows (not illustrated) that eject ink droplets. The liquid ejecting unit 3 is also referred to as an ejecting head, a printing head, a recording head, or the like.

In the present embodiment, ink colors are four kinds of cyan, magenta, yellow, and black. The ink colors are not limited to those four kinds, and may be any one or two kinds thereof, and further may be five or more kinds including light magenta and the like.

Upon receiving a control signal from the controlling unit 17, the liquid ejecting unit 3 ejects the ink to the medium M to record image information, while reciprocating in the width direction that intersects a transport direction F of the medium M.

In the present embodiment, both a one-way recording that ejects the ink while moving in one direction of a reciprocation, and a reciprocal recording that ejects the ink while moving in both forward and backward directions of the reciprocation can be performed.

Medium Supporting Unit, Heating Unit

The medium supporting unit 7 has a planar support face 5 capable of supporting the medium M. The medium M is slided on the support face 5 in the transport direction F (Y-axis direction) and transported by a transport roller (not illustrated). The support face 5 is formed to have a flatness needed to support the medium M and to keep a paper gap, which is a distance between the medium M and the ejecting nozzles of the liquid ejecting unit 3, to be constant.

On a back surface 4 opposite to the support face 5 of the medium supporting unit 7, an electric heating type heating unit 15 is provided along the width direction of the medium M. Here, the heating unit 15 is constituted by a plurality of heaters provided along the width direction (X-axis direction) of the medium M. The heating unit 15 may be constituted by a single heater instead of the plurality thereof.

Medium Width Detector

The medium width detector 9 detects the width d of the medium M supported by the support face 5. In the present embodiment, an optical reflection sensor is used in the medium width detector 9, and the medium width detector 9 is attached to the liquid ejecting unit 3. The medium width detector 9 utilizes a change in reflectance at a position of a side 13 of the medium M which is an end portion in the width direction of the medium M as a boundary, and detects the position of the side 13 and the width d of the medium M.

Of course, the medium width detector 9 is not limited to the optical reflection sensor, as long as it is capable of detecting information regarding the width of the medium M.

Air Blowing Ports, Air Blowing Unit

In the printing apparatus 1, an air blowing unit 2 is arranged at a location above the liquid ejecting unit 3 and the medium supporting unit 7. The air blowing unit 2 includes the plurality of air blowing ports 11, 11, . . . and the air blowing unit 23. The air blowing ports 11, 11, . . . are arranged in a range in which air can be blown over an entire width of a medium Mx having a maximum width dx that can be printed by the printing apparatus 1.

In the present embodiment, the air blowing unit 23 is constituted by a plurality of fans 23, 23, . . . (using the same reference numerals as the air blowing unit). The air blowing unit 2 is constituted by a suction chamber 4 sucking outside air A and a suppression chamber 16.

The suction chamber 4 and the suppression chamber 16 are partitioned by a wall 8. The plurality of fans 23, 23, . . . are attached to the wall 8. The air blowing ports 11, 11, . . . are provided at the suppression chamber 16.

In the present embodiment, opening areas of the air blowing ports 11, 11, . . . are all the same. Since each air blowing port has the same size, it is easy to adjust the blowing amount. The smaller the opening areas of the air blowing ports 11, 11, . . . , the easier to adjust the blowing amount, thus preferable. The opening areas of the air blowing ports 11, 11, . . . may not be the same size but may be different according to a specification of the printing apparatus 1.

The fans 23, 23, . . . suck the outside air A from an opening 10 (FIGS. 1 and 2) of the suction chamber 4 and blow it to the suppression chamber 16. The outside air A blown to the suppression chamber 16 is suppressed in the suppression chamber 16 and goes out from the air blowing ports 11, 11, . . . .

The outside air A exited from the air blowing ports 11, 11, . . . is guided by a flow path 12 to a region where the liquid ejecting unit 3 and the medium supporting unit 7 exist, and is subjected to dry the ink ejected to the medium M. Then, the outside air A subjected to the dry goes out from an outlet 14 provided in the printing apparatus 1.

Partitions

In the present embodiment, as described above, the air blowing units 23, 23, . . . are constituted by the plurality of fans 23, 23, . . . arranged along the width direction of the medium M. Further, in a region 27 between the plurality of fans 23, 23, . . . and the plurality of air blowing ports 11, 11, . . . , partitions 19, 19, . . . are respectively arranged between the fans 23, 23, . . . next to each other. Air from each of the fans 23, 23, . . . is blown out from each of air blowing ports 11 in six ranges R1, R2, R3, R4, R5, and R6 partitioned by the partitions 19, 19, . . . respectively.

The controlling unit 17 adjusts an output of each of the fans 23, 23, . . . according to the width d of the medium M. As a result, the blowing amount from each of the air blowing ports 11, 11 . . . is adjusted.

Alignment Unit

In the present embodiment, the medium supporting unit 7 includes an alignment unit 25 that aligns a side 6 of the medium M on one end side in the width direction. The printing apparatus 1 has a structure in which the medium M is positioned and set with reference to one side thereof in the width direction, and a position of the side 13 changes depending on the width of the medium M.

Then, the controlling unit 17 is configured to adjust the blowing amount from each of the air blowing ports 11, 11, . . . located at a position corresponding to the side 13 on the other end side of the medium M in a state in which the side 6 of the medium M is aligned by the alignment unit 25, according to the width of the medium M.

Controlling the Blowing Amount

Figure 3:
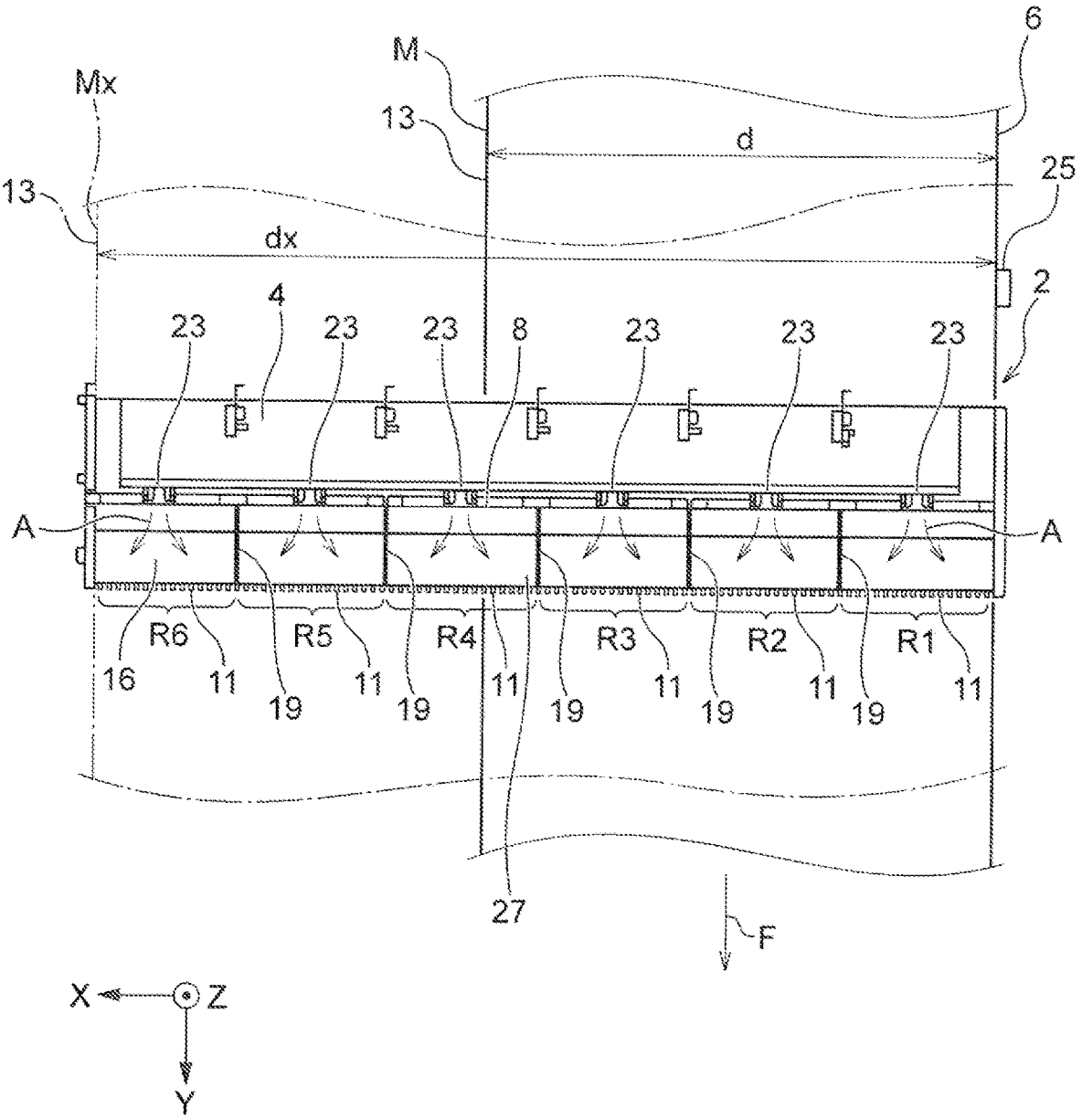
FIG. 3 is a cross-sectional view omitting an upper surface of the air blowing unit of the printing apparatus according to the First Exemplary Embodiment.

Specifically, in FIG. 3, two ranges R6, R5 on the left side in the six ranges R1, R2, R3, R4, R5, and R6 partitioned by each of the partitions 19, 19, . . . are entirely exposed, so that the corresponding fans 23 are turned off and no air is blown therefrom to the medium M.

The third range R4 from the left is in a partially exposed state and the output of the fan 23 is lowered. The degree of lowering the output depends on the position of the side 13 of the medium M. When the side 13 is at a position where the exposure is large, the degree of lowering the output becomes large, and when the side 13 is at a position where the exposure is small, the degree thereof becomes small. The degrees are preset.

Since the three ranges R1, R2, and R3 from the right are covered with the medium M, the fans 23 maintain default original outputs.

Description on Effects of First Exemplary Embodiment (1) According to the present embodiment, the controlling unit 17 controls the blowing amount from each of the plurality of air blowing ports 11, 11, . . . according to the width d of the medium M detected by the medium width detector 9, as described above. As a result, the amount of air that strikes a region not covered with the medium M can be reduced, and thus a temperature decrease of that portion can be suppressed. Thus, the temperature decrease at the end portion of the medium M can be suppressed.

(2) Further, according to the present embodiment, the controlling unit 17 adjust the blowing amount from each of the air blowing ports 11, 11, . . . located at the position corresponding to the side 13 of the medium M which is at the opposite side to the alignment unit 25, according to the width of the medium M. That is, as described above, since the blowing amount from each of the air blowing ports 11, 11, . . . is adjusted on a side where a region not covered with the medium M is generated, the temperature decrease at the end portion of the medium M is efficiently suppressed.

(3) Further, according to the present embodiment, the controlling unit 17 adjust each output of the fans 23, 23, . . . according to the width d of the medium M, thus controlling the blowing amount from each of the air blowing ports 11, 11, . . . . That is, the blowing amount from each of the corresponding air blowing ports 11 can be adjusted by adjusting the blowing amount from each fan 23. As a result, the blowing amount from each of the air blowing ports 11, 11, . . . can be adjusted with a simple structure, and thus the temperature decrease at the end portion of the medium M can be suppressed.

(4) Further, according to the present embodiment, since the heating unit 15 is constituted by the plurality of heaters provided along the width direction of the medium M, heating unevenness in the width direction of the medium M can be reduced.

Second Exemplary Embodiment

A second exemplary embodiment of the printing apparatus according to the present disclosure will be described below with reference to FIG. 4.

Common components with the first exemplary embodiment are referenced using like numbers, and no descriptions for such components are provided below. Further, description on the same actions and effects as the first exemplary embodiment will be omitted, too.

Movable Partition Plate

The printing apparatus 1 according to the first exemplary embodiment has the structure that divides the flow path to a blowing target of the outside air A by the plurality of fans 23, 23, . . . and the plurality of partitions 19, 19 . . . , and adjusts the blowing amount according to the width d of the medium M by adjusting each output of the fans 23, 23, . . . .

Figure 4:
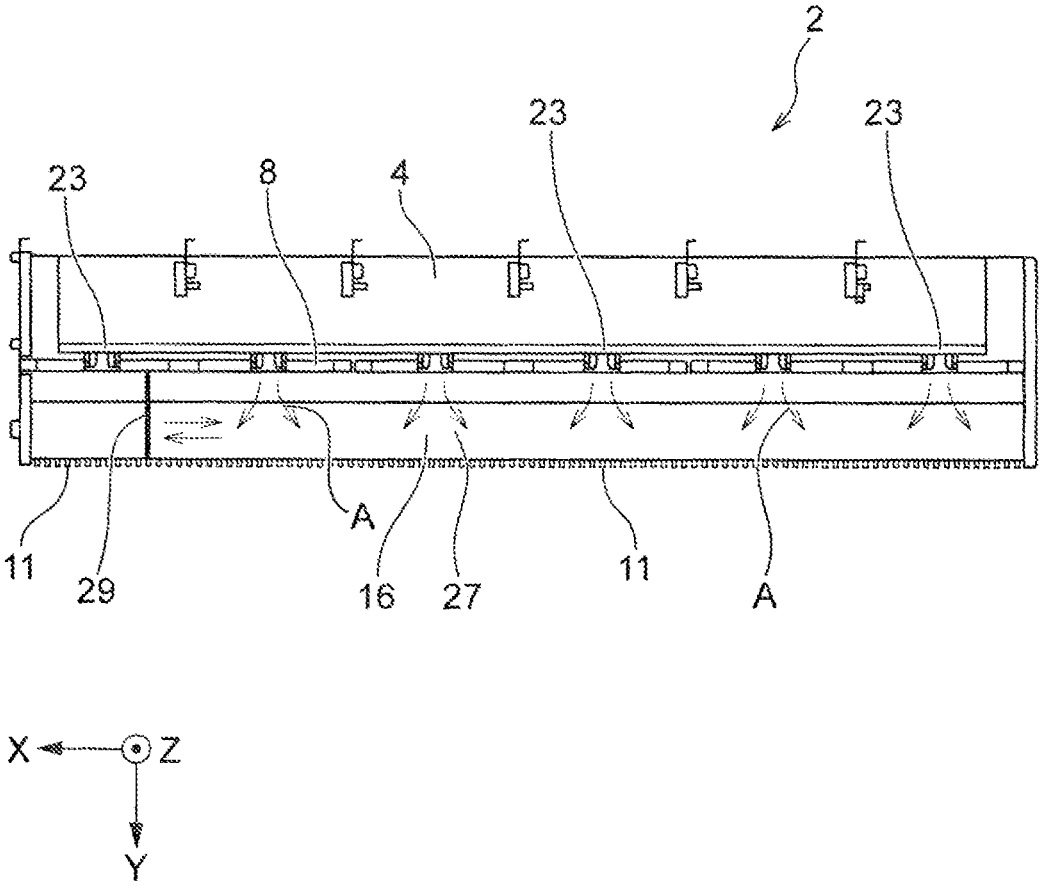
FIG. 4 is a cross-sectional view omitting an upper surface of an air blowing unit of a printing apparatus according to Second Exemplary Embodiment.

In contrast, in the second exemplary embodiment, as illustrated in FIG. 4, the printing apparatus 1 has a structure that adjusts the blowing amount using a movable partition plate 29. That is, in the present embodiment, in a single region 27 between the plurality of fans 23, 23, . . . which are the air blowing units and the plurality of air blowing ports 11, 11, . . . a movable partition plate 29 movable between the one end side and the other end side in the width direction of the medium supporting unit 7 is arranged. The movable partition plate 29 partitions the region 27 so that one side and the other side of the movable partition plate 29 become two independent regions.

Examples of a driving mechanism of the movable partition plate 29 include a structure in which the movable partition plate 29 is attached to a driving belt (not illustrated) and the driving belt is moved.

The controlling unit 17 changes a position of the movable partition plate 29 according to the width d of the medium M. As a result, a ratio of the two regions divided by the movable partition plate 29 changes. As a result, the air blowing ports 11, 11, . . . are also divided into the two regions by the movable partition plate 29, so that the blowing amount can be controlled.

In a state illustrated in FIG. 4, the medium supporting unit 7 at a region located to the left of the movable partition plate 29 is not covered with the medium M. Accordingly, one fan 23 located at the left side of the movable partition plate 29 is turned off, and five fans 23, 23, . . . located at the right side of the movable partition plate 29 are turned on.

Description on Effects of Second Exemplary Embodiment

According to the present embodiment, the controlling unit 17 changes the position of the movable partition plate 29 according to the width d of the medium M, thus controlling the blowing amount from each of the air blowing ports 11, 11, . . . . As a result, by moving the movable partition plate 29 between the regions not covered and covered with the medium M, the blowing amount can be effectively reduced.

Other Exemplary Embodiments

The printing apparatus 1 according to the exemplary embodiments of the present disclosure is based on the configuration described above. However, as a matter of course, modifications, omission, and the like may be made to a partial configuration without departing from the gist of the disclosure of the present application.

(1) In each above-described embodiment, the printing apparatus having the structure including the alignment unit and aligning the medium M with reference to one side in the width direction thereof is described. However, the printing apparatus may have a structure that performs an alignment with reference to a center in the width direction or any other structure, as far as the medium width detector 9 can detect the positions of the both sides 6 and 13 of the medium M and detect the width d.

(2) In each of the above-described embodiments, the structure having the plurality of fans 23 is described, but the fan 23 may be one. In this case, by respectively providing shutters at the plurality of air blowing ports 11, 11, . . . , it is possible to adjust the blowing amount and the blowing position.

(3) As described above, examples of the adjustment of the blowing amount from each of the plurality of air blowing ports 11, 11, . . . includes controlling the blowing amount of each of the air blowing ports 11, 11, . . . , and controlling the blowing amount of each predetermined range in which the plurality of air blowing ports 11, 11, . . . are put together (First Exemplary Embodiment). However, the structure in which both structures are combined may be used.

What is claimed is:

1. A printing apparatus comprising:

a liquid ejecting unit configured to eject liquid to a medium;

a medium supporting unit configured to support the medium on a support face;

a medium width detector configured to detect a width of the medium supported at the supporting face;

a plurality of air blowing ports provided along a width direction of the medium for blowing air toward the medium supporting unit;

an air blowing unit from which the air is blown;

a heating unit configured to heat the medium supporting unit; and a controlling unit configured to control a blowing amount from each of the plurality of air blowing ports according to the width of the medium detected by the medium width detector, wherein, in a region between the air blowing unit and the plurality of air blowing ports, a movable partition plate movable between one end side and an other end side in the width direction of the medium supporting unit is arranged, and the controlling unit controls the blowing amount from each of the air blowing ports by changing a position of the movable partition plate according to the width of the medium.

2. The printing apparatus according to claim 1, wherein the medium supporting unit includes an alignment unit configured to align a side of the medium on a first end side of the medium supporting unit in the width direction, and the controlling unit adjusts the blowing amount from each of the air blowing ports located at a position corresponding to a second end side of the medium, according to the width of the medium.

3. The printing apparatus according to claim 1, wherein the heating unit includes a plurality of heaters provided along the width direction of the medium.

4. The printing apparatus according to claim 1, wherein each of the air blowing ports has the same size.

* * * * *